US006792781B1

(12) United States Patent
Bindernagel et al.

(10) Patent No.: US 6,792,781 B1
(45) Date of Patent: Sep. 21, 2004

(54) ARRANGEMENT FOR INCLINED ROLLING OF TUBE-SHAPED OR BAR SHAPED ROLLING PRODUCTS

(75) Inventors: Ali Bindernagel, Wermelskirchen (DE); Herrmann Moeltner, Grevenbroich (DE)

(73) Assignee: Kocks Technik GmbH & Co., Hilden (DE)

( * ) Notice: Subject to any disclaimer, the term of this patent is extended or adjusted under 35 U.S.C. 154(b) by 0 days.

(21) Appl. No.: 09/575,001

(22) Filed: Nov. 3, 1997

Related U.S. Application Data

(63) Continuation of application No. 08/615,025, filed on Mar. 13, 1996, now abandoned.

(30) Foreign Application Priority Data

Mar. 24, 1995 (DE) ..... 195 10 715

(51) Int. Cl.[7] ..... B21B 19/02
(52) U.S. Cl. ..... 72/78
(58) Field of Search ..... 72/78, 100

(56) References Cited

U.S. PATENT DOCUMENTS 1,368,413 A 2/1921 Stiefel
4,587,820 A * 5/1986 Bohmer ..... 72/78

FOREIGN PATENT DOCUMENTS

| | | | |
|---|---|---|---|
| DE | 1602153 | 5/1967 | |
| DE | 1602153 B2 | 5/1967 | |
| JP | 57-112910 * | 7/1982 | ..... 72/78 |

* cited by examiner

*Primary Examiner*—Lowell A. Larson
(74) *Attorney, Agent, or Firm*—Michael J. Striker

(57) ABSTRACT

An arrangement for inclined rolling of tube-shaped or bar-shaped rolling products comprises at least two rollers adapted to receive therebetween a rolling product so as to determine a longitudinal axis of the rolling product, the rollers are driveable and are rotatable about said longitudinal axis. The rollers have roller axes inclined at an inclination angle relative to the longitudinal axis, the roller axes being inclined in such a plane which, when considered in or against the longitudinal axis, extends parallel to the longitudinal axis at a radial distance from it, and a driving unit for driving the rollers. The driving unit includes a sun gear and drive gears provided with an axis-offset bevel gear toothing and surrounding a respective one of the roller axes, the drive gears engaging with the sun gear so that the rollers are driven by the sun gear through the drive gears.

6 Claims, 4 Drawing Sheets

FIG.1
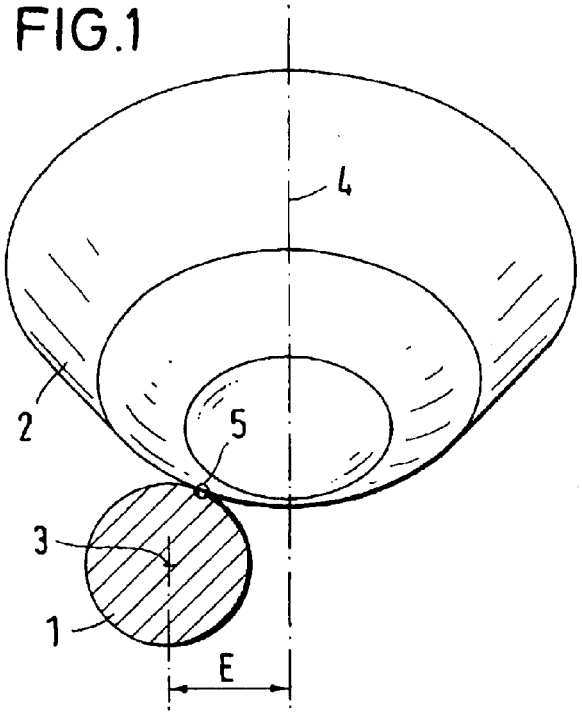
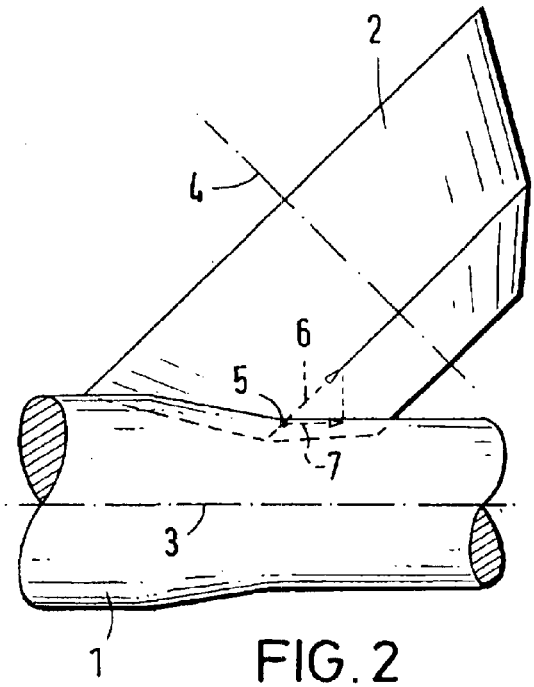
FIG. 2
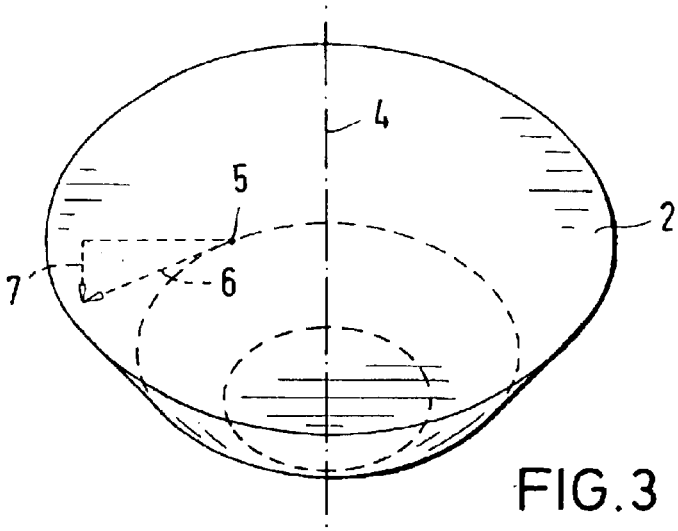
FIG.3

ARRANGEMENT FOR INCLINED ROLLING OF TUBE-SHAPED OR BAR SHAPED ROLLING PRODUCTS

This application is a continuation of application Ser. No. 08/615,025, filed Mar. 13, 1996 now abandoned.

BACKGROUND OF THE INVENTION

The present invention relates to an arrangement for inclined rolling of tube-shaped or bar-shaped rolling products.

Arrangements for inclined rolling are mainly used for manufacture of seamless tubes, for example perforation of a round insert block and thereby for manufacture of relatively thick walled hollow block, or for stretching of such a hollow block with a reduction of its wall thickness or for expanding a tube loop. Moreover, it is known to use such arrangements for stretching and for cross-section reduction of bar-shaped or in other words massive rolling products.

In conventional arrangements of this type the rolling product is driven in rotation in two rollers which rotate in the same rotary direction and thereby is deformed. For obtaining a controllable displacement of the rolling product in the longitudinal direction the roller axes are arranged relative to the longitudinal axis of the rolling product with a pivoting angle. Therefore, from the peripheral speed of the rollers, a component in the longitudinal direction of the rolling product is produced and the rolling product is moved in a helical movement between the rollers in the longitudinal direction. Such arrangements have two or more driven rollers. Lateral guides between the rollers are needed when only two rollers are provided so that the rolling product remains in the region of the rolling axis does not spring out in a radial direction.

In such arrangements the barrel-shaped rollers are utilized with the roller axes extending parallel to the longitudinal axis of the rolling product. Moreover, it is known to use conical rollers in which the roller axes are inclined to the longitudinal axis of the rolling product. The inclination angle which is obtained here between the roller axes and the longitudinal axis of the rolling product should not be confused with the above mentioned pivoting angle, since the inclination angle alone without turning of the roller axes cannot provide an axial feed of the rolling product.

In the above mentioned arrangement the rolling product rotates about its longitudinal axis, which causes several problems. First of all rolling products of limited length only can be rolled, in order to avoid its unsteady rotary movement and to prevent damages to the rolling product and to the arrangement. -Secondly, expensive guiding devices for the rolling product and for eventually available inner tools are needed. Thirdly, the rolling product throughput and thereby the efficiency of the arrangement is narrowly limited. The rolling product throughput is determined by the feeding speed, and it is produced from the peripheral speed of the rolling product and the magnitude of the pivoting angle. Since the pivoting angle cannot exceed a predetermined magnitude because otherwise the surface of the rolling product becomes non-uniform and in particular wavy, the rolling product throughput is increased only by an increase in the peripheral speed. However, this increases the rotary speed of the rolling product as well which leads to an unsteady running resulting in damages to the rolling product, disturbances in the machinery and increased wear. Moreover, the rolling product during rolling must be accelerated stronger in view of the higher rotary speed of the rolling, which leads to sliding of the rollers and thereby to gripping problems. Fourthly, the rolling product which rotates about its longitudinal axis prevents a continuous finishing rolling in longitudinal rolling stands arranged at a short distance.

In view of the above disadvantages the kinematic principle of the inclined rolling was reversed. In particular it has been changed so that the rollers rotate not only around their roller axes, but also around the longitudinal axis of the rolling product. As a result the rolling product must not be brought to rotation about its longitudinal axis. The rollers roll in a planetary movement on and around the rolling product.

Such an arrangement is disclosed for example in U.S. Pat. No. 1,368,413. Here the rollers are supported with their roller shafts in a rotary housing which is driven through a toothed rim and a pinion. The shafts which drive the rollers has ends which face away from the rollers and are provided with toothed gears rolling on a sun gear as in a planetary transmission. The sun gear is also driven. With a corresponding determination of the rotary speeds of the rollers and the rotatable housing it is possible to roll the rollers on the rolling product without driving it in rotation. The rollers of this known type are barrel shaped and their roller axes extend in planes which are parallel to the longitudinal axis of the rolling product. The roller axes however are turned by an angle relative to the longitudinal axis of the rolling product in these planes, and thereby the feeding movement of the rolling product is produced. Also, the axes of the planetary gears extend with this angle relative to the longitudinal axis of the rolling product, but they are located in a plane which includes the longitudinal axis of the rolling product. The roller drive shafts between the planetary gears and the rollers are provided at their ends with joint couplings. In order to maintain the bending angle of the joint couplings not too great, the roller drive shafts are relatively long. This however leads to a long construction of the rotatable housing. Moreover, the long roller drive shafts are subjected during rotation of the rotatable housing to centrifugal forces and gyroscopic moments, which limits the rotary speed of the housing.

The German document DE-OS 16 02 153 shows in FIG. 1 an arrangement which in principle has the above described features. FIG. 2 however illustrates another construction. Here the rollers are conical and the roller axes extend under an inclination angle relative to the longitudinal axis of the rolling product. The rollers are supported floatingly in heads which are arranged at the end side of a rotor housing rotating around the longitudinal axis of the rolling product and driven through a toothed rim. The rollers are driven through several toothed gears or toothed gear drive steps arranged radially from the longitudinal axis of the rolling product one after the other. The first toothed gear engages a sun gear and rolls on it by the rotary movement of the rotor housing in which it is supported. In U.S. Pat. No. 1,368,413 the sun gear in this known construction is rotated by a special drive. The rotary speed of the sun gear and the rotary speed of the rotor housing can be selected so that the rollers roll on the rolling product without driving it in rotation. With the above mentioned inclination of the roller axes relative to the longitudinal axis of the rolling product no rolling product feed can be obtained. The feed is produced by a pivoting of the head which is arranged turnably around a bevel gear axis on the rotor housing. The pivoting angle produced in this manner is not shown in FIG. 2 of this reference. This construction has three rollers and is provided both for tube-shaped and for bar-shaped rolling products.

The latter construction is very expensive because of its roller drive. The toothed gears of the roller drive staggered radially outwardly from the longitudinal axis of the rolling product operates so that the rotating rotor housing has a huge outer diameter which, depending on the cross-sectional size of the rolling product, amounts to approximately 3–5 meter. The rollers, the roller shaft, their bearings and the head which has the drive gears are arranged on this big rotor housing, so that extraordinarily high rotating masses are produced in the case of great outer diameters. Because of the thusly generated centrifugal forces, the rotary speed of the rotor housing with the head is very limited and therefore the feeding speed of the rolling product is also limited. As a result, the throughput of the rolling product per time unit and therefore the efficiency is low. Since the head as well as the rotor housing have great sizes and there is a relatively great distance of the pivoting axis of the head from the corresponding roller axes, an exact adjustment and maintenance of the roller position is difficult, and different springing of the rollers under load must be taken into consideration. Because the radially outwardly staggered gear teeth is the bevel gear drive of the rollers located far outside and therefor it requires a very steep inclination of the roller axes relative to the longitudinal axis of the rolling product, in order that the axial length of the arrangement as well as the rotor housing and the heads become greater. An inclination of the roller axes relative to the longitudinal axis of the rolling product is generally advantageous. However, when this inclination is too steep rollers are produced with specially pronounced or in other words flat conical shape with a strong reduction of the roller diameter, especially in the region of the roller tip. The smoothing zone and the rounding zone of the rollers is located where the strong diameter reduction acts in a specially negative way, causing undesired twisting of the rolling product during rolling. This danger is caused in the known construction by the necessary steep inclination of the roller axes and thereby required flat conical shape of the rollers.

SUMMARY OF THE INVENTION

Accordingly, it is an object of the present invention to provide an arrangement for inclined rolling of tube-shaped and bar-shaped rolling products, with two or more driven rollers which are rotatable about the longitudinal axis of the rolling product and have roller axes extending inclinedly under an inclination angle relative to the longitudinal axis of the rolling product.

It is an object of the present invention to provide an arrangement of this type which avoids the disadvantages of the prior art and has smaller dimensions with increased efficiency.

In keeping with these objects and with others which will become apparent hereinafter, one feature of the present invention resides, briefly stated, in an arrangement of the above mentioned type in which for producing a rolling product feed the roller axes are inclined in such planes which extend, when considered in or opposite to the longitudinal axis of the rolling product, with a radial distance parallel near the longitudinal axis of the rolling product, and the rollers are driven by a sun wheel through a drive gear which has an axis-offset bevel gear toothing, engages with the sun gear and surrounds the corresponding roller axes.

In the arrangement in accordance with the present invention, the rolling product feed can be produced not only as in the known constructions with a turning of the rollers and the roller axes under a pivoting angle relative to the longitudinal axis of the rolling product, but such a turning can be dispensed when the roller axes extend correspondingly within a plane arranged at a radial distance from and parallel to the longitudinal axis of the rolling product as considered in or opposite to the longitudinal axis of the rolling product. This new arrangement of the roller axes produces however the desired rolling product feed only when the roller axes are inclined within the above mentioned planes under an inclination angle relative to the longitudinal axis of the rolling product, or in other words the rollers are formed substantially cone-shaped or truncated cone-shaped. When the rollers are barrel-shaped or cylindrical and their roller axes have no inclination angle, no rolling product feed is produced without the pivoting angle. When substantially conical rollers and thereby roller axes are utilized instead and they are inclined under an inclination angle relative to the longitudinal axis of the rolling product, the additional utilization of a pivoting angle can be dispensed with as available in the above mentioned constructions with driving of the rolling product in the longitudinal direction.

In the inventive arrangement, when considered in or against the longitudinal axis of the rolling product, the laterally offset, parallel arrangement of the roller axes relative to the longitudinal axis of the rolling product with an inclination angle which is not seen with this view, a substantially compact construction of the arrangement is provided. The reason is that it is possible to arrange each roller axes or roller shaft in association with a drive gear for the rollers, which engages directly with the sun gear and thereby rolls on it. Therefore, all joint shafts and joint couplings or toothed gears located between the sun gear and the roller shafts are dispensed with. With the laterally parallel offset of the roller axes in the construction having the drive gears and the sun gear it is however necessary to use an axis-offset bevel gear toothing which is known from other solutions. Since in such construction numerous parts are eliminated, the masses rotating about the longitudinal axis of the rolling product are reduced, the distance between the remaining parts from the longitudinal axis of the rolling product is small, and the centrifugal forces are substantially reduced. Therefore the arrangement can be not only substantially smaller for the same cross-section of the rolling product, but also the rotation can be performed with substantially higher rotary speed about the longitudinal axis of the rolling product and as a result a higher throughput of the rolling product or in other words a substantially improved efficiency is obtained. In the inventive solution the inclination angle between the roller axes and the longitudinal axis of the rolling product is also relatively small. This not only makes the drive gears and therefore the whole arrangement small, but also leads to a less pronounced conical shape of the rollers or in other words to a more cylindrical roller shape. With this roller shape the roller diameter decreases less, especially in the region of the smoothing zone and the rounding zone. Therefore the twisting of the rolling product is avoided, which otherwise easily occurs especially in the case of rolling thin walled tubes in this region.

In accordance with an advantageous embodiment of the present invention, the drive gears engaging with the sun gear are arranged fixedly and directly on the shafts which carry the rollers. In this construction an adjustment of the radial distance of the roller or the roller axes from the longitudinal axis of the rolling product is not possible, so that feed of the rolling product remains the same. When in this embodiment the drive gears are also arranged non-displaceably in the axial direction on the shaft carrying the rollers, then in view of the fact that it is necessary to maintain the engagement of the toothed gears, also an axial displacement of the shafts which carry the rollers and also the axial displacement of the rollers is not possible. When differently thick inserts are arranged between the rollers and the shaft which carry the rollers, then in this embodiment the rollers can be adjusted in the axial direction and therefore in view of their inclination relative to the axis of the roller product the diameter of the rolling product can be also adjusted. During rolling of tubes, the wall thickness of the rolling product can be adjusted by corresponding selection of the diameter of the inwardly located tool to the desired size. It is generally faster and more accurate than a roller adjustment and avoids an undesirable change of the cylindrical smoothing caliber shape. Moreover, in this simple embodiment an especially compact arrangement with a high stability against the occurring roller forces is provided.

It is also possible to form the drive gears which engage with the sun gears so that in their hub region a hollow toothing is arranged, and an outer toothing of a shaft which carries a respective roller engages in the hollow toothing. The shaft can be supported in a rotatable eccentric bushing and adjustable transversely to the drive gear and to the longitudinal axis of the rolling product. In this arrangement the radial distance of the roller axes from the longitudinal axis of the rolling product can be adjusted and thereby the feed of the rolling product can be changed.

In accordance with a further advantageous embodiment of the invention, the rollers are adjustable in direction of their roller axes. This can be provided first of all by an axially displaceable and preferably steplessly adjustable support of the shafts which carry the rollers. In this manner the smallest diameter described jointly by all rollers can be changed, and thereby the finishing diameter of the rolling product can be changed as well. The adjustability of the shafts and the rollers in the longitudinal direction of the roller axes can be also combined with the previously mentioned transverse adjustment of the roller axes, so that in such an arrangement both the outer diameter of the rolling product and the feed of the rolling product can be changed. On the other hand, an adjustment of the rollers in direction of their roller axes can be performed in the above described manner by inserts. The produced rollers can be brought to a desired position by the use of other inserts, so as to obtain a high accuracy and reproducibility of the caliber adjustment.

The above described constructions and approaches to the axial and radial adjustment of the rollers and their roller shafts can be also utilized for other structural solutions.

In accordance with an especially advantageous embodiment of the invention, all four driven rollers are provided. The use of four instead of frequently utilized three rollers has the advantage that the cross-section of the rolling product can be enclosed narrower by the rollers. This leads especially during rolling of thin walled tubes, to a smaller expansion of the rolling product between the rollers and thereby to a reduction of additional bending loads and sliding of the workpiece. Moreover, with the four rollers, the roller diameter which leads to the maximum possible embracing of the rolling product is smaller than in the case of three rollers. Smaller roller diameters provide for a substantial advantage of smaller rolling moments. Therefore, all parts of the roller drive and the rotor can be smaller and lighter and the arrangement as a whole can be more compact. The use of the rollers with the smaller diameter in which the reduction of the roller diameter in the region of the smoothing zone and the rounding zone therefore the problem of the rolling product sliding is grave, is not problematic in the inventive arrangement since it utilizes an especially flat inclination angle which acts in a compensating manner.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 1–3 are views showing an arrangement for inclined rolling of tube-shaped and bar-shaped rolling products correspondingly on a front view, a side view and a plan view;

DESCRIPTION OF THE PREFERRED EMBODIMENTS

Figure 4:
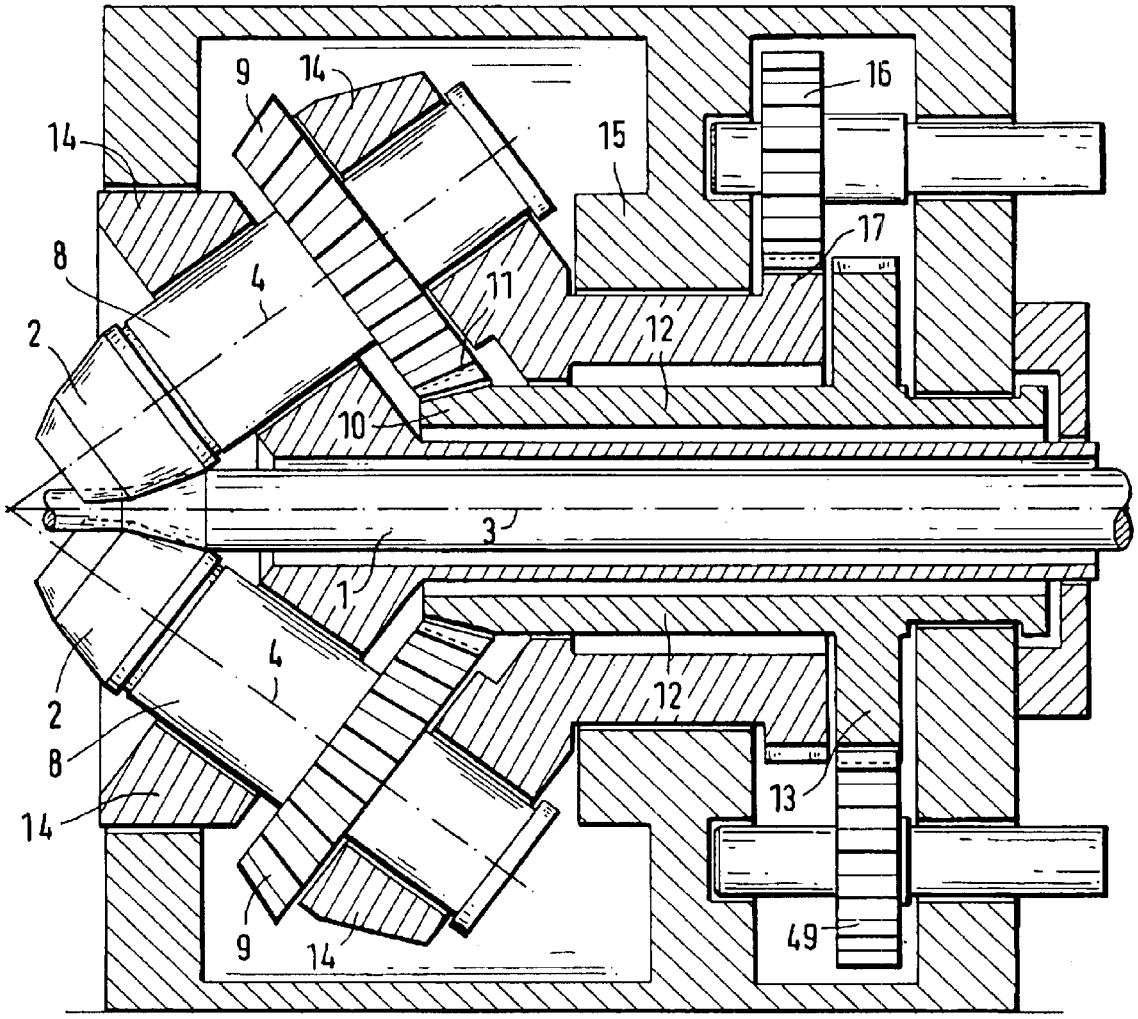
FIG. 4 is a view showing the inventive arrangement without a roller adjustment in a schematic illustration.

The cross-sectional surfaces of a rolling product is identified with reference numeral 1 on a front view of FIG. 1. It is formed as a massive bar. The rolling product can however be also formed as a tube or a tube loop, and an inner tool such as for example a mandrel rod can be located in it. The rolling product 1 is formed by several rollers 2 which surround the rolling product 1. In FIGS. 1–3 only one roller 2 is shown for the clarify of illustration of the inventive features. The rollers 2 gyrate in a planetary fashion around an axis 3 of the rolling product extending perpendicular to the plane of the drawing in FIG. 1. The rollers 2 rotate their roller axes 4 and roll on an outer surface of the rolling product 1. The rollers 2 in the shown example are substantially conical. They have the shape of two frusto-cones arranged over one another and having differently inclined peripheral surfaces. It is especially clearly shown on the side view of FIG. 2, in which it can be seen that the roller axes 4 extend under an inclination angle relative to the longitudinal axis 3 of the rolling product. This known inclination angle does not cause any axial feed of the rolling product 1 when the roller axes 4 and longitudinal axis 3 of the rolling product are located in one plane. The additionally utilized pivoting angle which is provided in the known constructions is not provided in the inventive arrangement, as can be seen in particular in FIG. 1. On the front view of this Figure when seen in or against the longitudinal axis 3 of the rolling product, it can be seen that the plane in which the roller axes 4 extend inclinedly is located parallel to the longitudinal axis 3 of the rolling product at a radial distance E from it. From the configuration of a contact point 5 between the roller 2 and the rolling product 1, it can be seen that the roller peripheral speed 6 produces a component 7 in the feeding direction of the rolling product 1. Also, from the plan view of FIG. 3 the component 7 which causes the feed can be recognized as well.

FIG. 4 shows an arrangement partially in a longitudinal section in which the rollers 2 and their roller axes 4 are arranged in the inventive manner. Two rollers 2 are visible on these drawings while two further rollers 2, forming together for example four rollers, are located in a foreground and in a background and therefore not shown for more clear illustration of the other two rollers 2.

The rollers 2 are driven by a motor. The drive is performed through shafts 8 which carry the rollers. Drive gears 9 are arranged directly on the shafts 8 and fixedly connected with them for joint rotation. The drive gears 9 engage with a sun gear 10 which surrounds the rolling product 1. For this purpose, an axis-offset bevel gear toothing 11 is used by reason of the distance E in FIG. 1. The sun gear 10 has a longitudinally extending drive bushing 12 which fixedly connects the sun gear 10 with a toothed gear 13 for joint rotation, and the toothed gear 13 is controllably driven through a pinion 49 from the not shown motor. The shafts 8 which carry the rollers 2 are rotatably supported in a rotor 14 which in turn rotates around the longitudinal axis 3 of the rolling product, since it is rotatably supported in a housing 15. The rotor 14 is driven by a further pinion 16 which engages in a toothed rim 17 of the rotor 14 and is also separably driven by a not shown motor.

Figure 5:
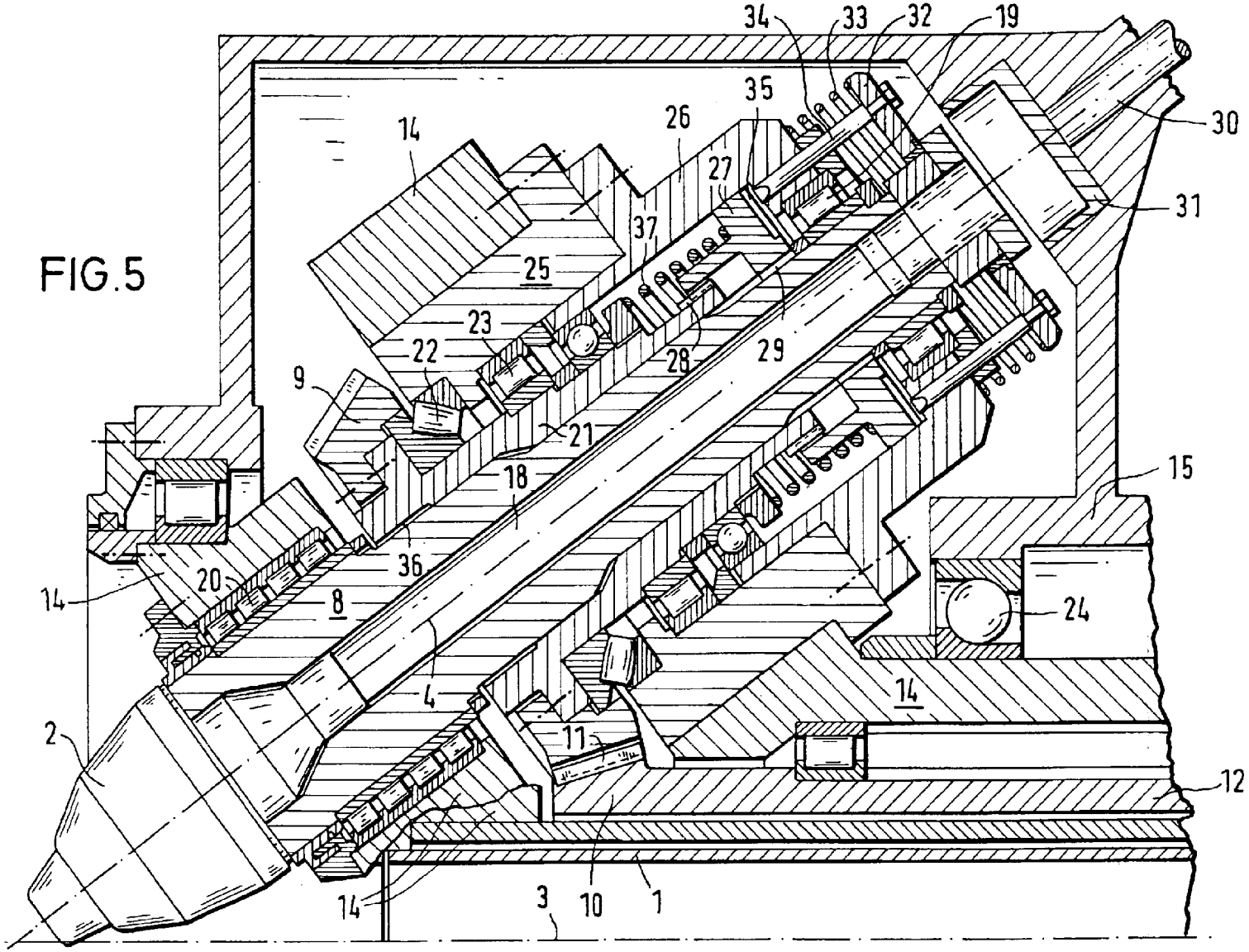
FIG. 5 is a view showing the inventive arrangement with an axial roller adjustment.

FIG. 5 shows a support for only one roller 2 on an enlarged scale, while the arrangement is formed substantially as shown in FIG. 4. Same or similar parts are identified here with the same reference numerals. The construction of FIG. 5 makes possible through an axial adjustment of the rollers 2 by adjusting the shafts 8, while the construction of FIG. 4 makes possible an axial adjustment of the rollers 2 only by differently thick inserts between the rollers 2 and the shafts 8. The rollers 2 are tensioned each by a pulling anchor 18 in an axial direction fixedly with its shaft 8, which pulling anchor is arranged in a central longitudinal opening of the shaft 8. Radial bearings 19 and 20 provide a limited but sufficient axial displacement of the shaft 8. The drive gear 9 is screwed in this construction with a bearing bushing 21 which is supported through an axial bearing 22 and the radial bearing 23 rotatably and axially non-displaceably in the rotor 14. The rotor, in turn, is supported through a bearing 24 in the housing 15. The rotor 14 has bushings 25 and 26 which surround both the shaft 8 as well as the bearing bushing 21 which surrounds the same. The bushings 25 and 26 are screwed with a rotor 14 and rotate with it around the longitudinal axis 3 of the rolling product. In other aspects, the bushings 25 and 26 are stationary. The same is true for the drive gear 9 and the bearing bushing 21. The shaft 8 and also the roller 2 as well as the pulling anchor 18 perform the rotary movement around the longitudinal axis 3 of the rolling product. However, with these parts a displaceable relative to the remaining parts in particular relative to the bushings 25 and 26 in or against the direction of the roller axes 4. The rotary fixed coupling between the bearing bushings 21 and the shaft 8 with the roller 2 is produced through a coupling bushing 27, which engages in a toothing 28 of the bearing bushing 21 and also in a toothing 29 of the shaft 8. The toothings 28 and 29 allow a relative displacement in the longitudinal direction. FIG. 5 shows this situation during the rolling operation, in which the drive rotary movement is transmitted from the drive gear 9 through the bearing bushing 21, the coupling bushing 27 and the shaft 8 to the roller 2.

When during adjustment of the arrangement the roller 2 must be displaced in the axial direction, the rotor 14 is turned to an adjusting position. A working cylinder 30 displaces by its bushing 31 a plate 32 against the action of a pressure spring 33 in an axial direction, so that the pressure pin 34 engages in a third toothing 35 of the coupling bushing 27 and couples it fixedly with the rotor 14. The pressure pin 34 presses the coupling bushing 27 further toward the roller 2 until the toothing 28 of the bearing bushing 21 is no longer in engagement with the coupling bushing 27, which is maintained however for the longer toothing 29 of the shaft 8. When the sun gear 10 is slowly rotated by a separate drive, then with the stationary rotor drive only the drive gear 9 with the bearing bushing 21 is rotated. A thread 36 between the shaft 8 and the bearing bushing 21 operates so that the shaft 8 is displaced in direction of the roller axis 4 with it the roller 2 is displaced as well. When its position is adjusted and the sun gear 10 is stopped, the working cylinder 30 is relieved from the pressure medium pressure and the plate 32 is released. The pressure spring 33 displaces the pressure pin 34 and a further pressure spring 37 displaces the coupling bushing 27 again to the operating position. In this position the toothing 28 is engaged and the shaft 8 as well as the roller 2 is driven again. The above described operation is true for each roller 2 and its support.

Figure 6:
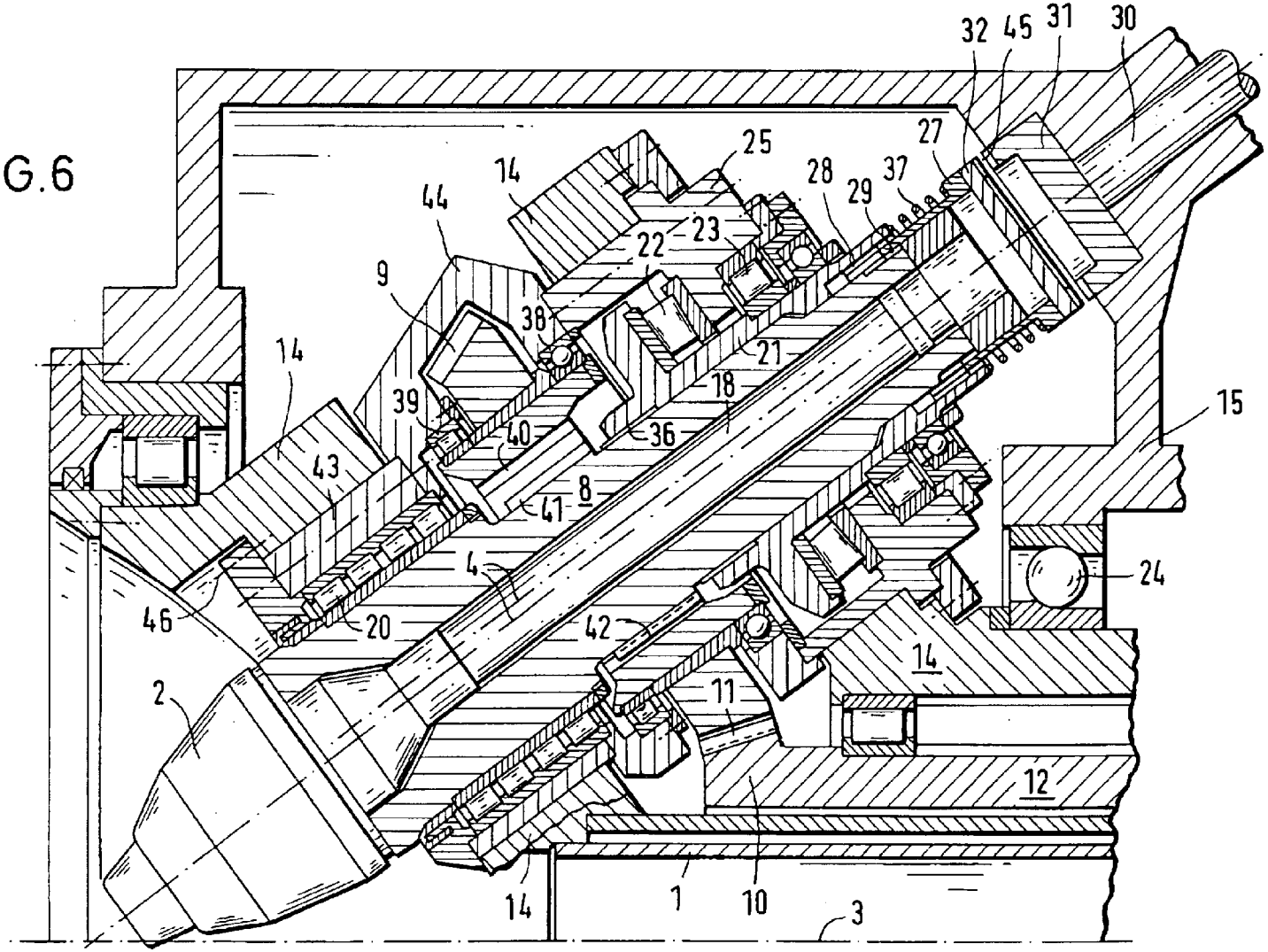
FIG. 6 is a view showing the inventive arrangement with an axial and radial roller adjustment.

FIG. 6 shows a substantially different construction of the arrangement. The parts which are identical or similar are identified with the same reference numerals as in FIG. 5, also, when the construction of these parts is somewhat different. For example the toothing 28 of the bearing bushing 21 in FIG. 6 is substantially longer than the toothing 29 of the shaft 8. The toothing 29 is as long as the engaging toothing on the coupling sleeve 27. When it is moved by the working cylinder 30 in direction of the roller 2, toothing 29 disengages faster in view of the shortened length. Then the shaft 8 and the roller 2 with it is rotatable by the sun gear 10 and the drive gear 9 relative to the fixedly held bearing bushing 21 and is displaceable because of the thread 36 in the axial direction. The bearing bushing 21 is held non-rotatably by the non-rotatably arranged and formed working cylinder 30 through its bushing 31, a toothing 45, the plate 32, the coupling bushing 27 screwed with it, and the toothing 28.

In the construction of FIG. 6 the other differences include the fact that the shaft 8 and the roller 2 with it is adjustable transversely to the longitudinal axis 3 of the rolling product. The drive gear 9 is rotatably supported in a connecting member 44 of the rotor 14 with a fixed bearing 38 and a movable bearing 39 and remains therefore in a correct engagement with the sun gear 10. The drive gear 9 is provided in the hub region with a hollow toothing 40 in which an outer toothing 41 engages. This is however only on a limited part of the periphery as identified with 42, since the outer toothing 41 of the shaft 8 has a substantially smaller diameter than the hollow toothing 40. The adjustment path of the shaft 8 is produced in this way. The shaft is supported in an eccentric bushing 43 which is rotatable and fixable in the rotor 14, and the bushing 25 in FIG. 6 is formed as such an eccentric bush. A timing of the eccentric bushings 25 and 43 in which the radial bearings 23 and 20 are located leads to a transverse displacement of the shaft 8 and the roller 2. The turning of both eccentric bushings is performed synchronously by the connecting member 44 coupled to them, after the screws 46 are loosened.

In the examples which are described above and shown in the drawings, the throughgoing direction of the rolling product is selected so that a converging arrangement of the rollers is provided. It is also however possible to change the throughgoing direction of the rolling product so that the roller arrangement is diverging. The latter is produced when the arrangement is utilized for example as an expanding roller stand for tubes.

It will be understood that each of the elements described above, or two or more together, may also find a useful application in other types of constructions differing from the types described above.

While the invention has been illustrated and described as embodied in an arrangement for inclined rolling of tube-shaped or bar-shaped rolling products, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. An arrangement for inclined rolling of tube-shaped or bar-shaped rolling products, comprising at least two rollers adapted to receive therebetween a rolling product so as to determine longitudinal axis of the rolling product, said rollers over their whole axial length being conical and each supported only at one axial end, said rollers being driveable and rotatable about said longitudinal axis, said rollers having roller axes inclined at an inclination angle relative to said longitudinal axis, said roller axes being inclined in such a plane which, when considered in or against the longitudinal axis, extends parallel to said longitudinal axis at a radial distance from it; and means for driving said rollers, said driving means including a sun gear provided with outer bevel-gear toothing and arranged to surround the rolling product and also drive gears provided with an axis-offset bevel gear toothing and surrounding a respective one of said roller axis, said drive gears directly engaging outside with said sun gear so that each of said rollers is driven by said sun gear through a single one of said drive gears.

2. An arrangement for inclined rolling of tube-shaped or bar-shaped rolling products, comprising at least two rollers adapted to receive therebetween a rolling product so as to determine a longitudinal axis of the rolling product, said rollers being driveable and rotatable about said longitudinal axis, said rollers having roller axes inclined at an inclination angle relative to said longitudinal axis, said roller axes being inclined in such a plane which, when considered in or against the longitudinal axis, extends parallel to said longitudinal axis at a radial distance from it; means for driving said rollers, said driving means including a sun gear and drive gears provided with an axis-offset bevel gear toothing and surrounding a respective one of said roller axes, said drive gears engaging with said sun gear so that said rollers are driven by said sun gear through said drive gears, said drive gears which engage said sun gear having a hub region provided with a hollow toothing; a plurality of shafts each supporting a respective one of said rollers and having an outer toothing engaging in said hollow toothing; and rotatable eccentric bushings each supporting a respective one of said shafts so that said shafts are transversely adjustable relative to said drive gears and said longitudinal axis.

3. An arrangement for inclined rolling of tube-shaped or bar-shaped rolling products, comprising at least two rollers adapted to rotate about an axis of a rolling product and having roller axes which extend at an inclination angle to the axis of the rolling product and also, for producing a rolling product feed are arranged at a radial distance from said longitudinal axis of the rolling product; means for driving said rollers and including a sun gear which surrounds the longitudinal axis of the rolling product and drives said rollers, said means for driving also including drive gears each engaging with said sun gear, each surrounding an axis of a corresponding one of said rollers and driving said corresponding one of said rollers, and each provided with an axis-offset bevel gear toothing.

4. An arrangement for inclined rolling of tube-shaped or bar-shaped rolling products, comprising at least two rollers adopted to receive therebetween a rolling product so as to determine a longitudinal axis of the rolling product, said rollers over their whole axial length being conical and each supported only at one axial end, said rollers being driveable and rotatable about said longitudinal axis, said rollers having roller axes inclined at an inclination angle relative to said longitudinal axis, said roller axes being inclined in such a plane which, when considered in or against the longitudinal axis, extends parallel to said longitudinal axis at a radial distance from it; and means for driving said rollers, said driving means including a sun gear provided with outer bevel-gear toothing and arranged to surround the rolling product and also drive gears provided with an axis-offset bevel gear toothing and surrounding a respective one of said roller axis, said drive gears directly engaging outside with said sun gear so that each of said rollers is driven by said sun gear through a single one of said drive gears, said rollers being adjustable in a direction of said roller axes.

5. An arrangement for inclined tolling of tube-shaped or bar-shaped rolling products, comprising at least two rollers adapted to receive therebetween a rolling product so as to determine a longitudinal axis of the rolling product, said rollers over their whole axial length being conical and each supported only at one axial end, said rollers being driveable and rotatable about said longitudinal axis, said rollers having roller axes inclined at an inclination angle relative to said longitudinal axis, said roller axes being inclined in such a plane which, when considered in or against the longitudinal axis, extends parallel to said longitudinal axis at a radial distance from it; and means for driving said rollers, said driving means including a sun gear provided with outer bevel-gear toothing and arranged to surround the rolling product and also drive gears provided with an axis-offset bevel gear toothing and surrounding a respective one of said roller axis, said drive gears directly engaging outside with said sun gear so that each of said rollers is driven by said sun gear through a single one of said drive gears; and shafts supporting said rollers, said drive gears which engage with said sun gear being arranged on said shafts and connected with said shafts for joint rotation therewith.

6. An arrangement for inclined rolling of tube-shaped or bar-shaped rolling products, comprising at least two rollers adapted to receive therebetween a rolling product so as to determine a longitudinal axis of the rolling product, said rollers over their whole axial length being conical and each supported only at one axial end, said rollers being driveable and rotatable about said longitudinal axis, said rollers having roller axes inclined at an inclination angle relative to said longitudinal axis, said roller axes being inclined in such a plane which, when considered in or against the longitudinal axis, extends parallel to said longitudinal axis at a radial distance from it; and means for driving said rollers, said driving means including a sun gear provided with outer bevel-gear toothing and arranged to surround the rolling product and also drive gears provided with an axis-offset bevel gear toothing and surrounding a respective one of said roller axis, said drive gears directly engaging outside with said sun gear so that each of said rollers is driven by said sun gear through a single one of said drive gears, said rollers including four driven rollers.

* * * * *